US011726514B2

(12) United States Patent
Shashwat et al.

(10) Patent No.: US 11,726,514 B2
(45) Date of Patent: Aug. 15, 2023

(54) ACTIVE COMPENSATION CIRCUIT FOR A SEMICONDUCTOR REGULATOR

(71) Applicant: STMicroelectronics International N.V., Geneva (CH)

(72) Inventors: Shashwat, Kaushambi (IN); Rajesh Narwal, Greater Noida (IN)

(73) Assignee: STMicroelectronics International N.V., Geneva (CH)

( * ) Notice: Subject to any disclaimer, the term of this patent is extended or adjusted under 35 U.S.C. 154(b) by 60 days.

(21) Appl. No.: 17/242,067

(22) Filed: Apr. 27, 2021

(65) Prior Publication Data

US 2022/0350357 A1 Nov. 3, 2022

(51) Int. Cl.
*G05F 1/59* (2006.01)
*G05F 1/575* (2006.01)

(52) U.S. Cl.
CPC ..... *G05F 1/59* (2013.01); *G05F 1/575* (2013.01)

(58) Field of Classification Search
CPC G05F 1/575; G05F 1/59; H02M 3/07; H02M 1/0045
See application file for complete search history.

(56) References Cited

U.S. PATENT DOCUMENTS 6,614,083 B1 * 9/2003 Yamazaki ..... H01L 29/4908 257/E29.279
8,169,203 B1 5/2012 Vemula
8,841,897 B2 9/2014 Williams et al.
9,348,350 B2 * 5/2016 Azuma ..... H02H 9/025
9,651,965 B2 5/2017 Cui et al.
9,651,966 B2 5/2017 Cui et al.
10,133,287 B2 11/2018 Yang
10,254,778 B1 4/2019 Sambucco et al.
10,324,482 B2 6/2019 Kumaz et al.
2006/0012356 A1 1/2006 Kase et al.
2012/0038332 A1 2/2012 Lin
2012/0187930 A1 * 7/2012 Williams ..... G05F 1/5735 323/273
2013/0002216 A1 1/2013 Kim
(Continued)

FOREIGN PATENT DOCUMENTS

CN 102880218 A * 1/2013
CN 106468932 A * 3/2017 ..... G05F 1/56
(Continued)

OTHER PUBLICATIONS

Rincon-Mora, "Active Capacitor Multiplier in Miller-Compensated Circuits," *IEEE Transactions on Solid-State Circuits* 35(1), pp. 26-32, Jan. 2000. (7 pages).

*Primary Examiner* — Sisay G Tiku
(74) *Attorney, Agent, or Firm* — Seed IP Law Group LLP

(57) ABSTRACT

An active compensation circuit for compensating the stability of a regulator is provided. The active compensation circuit presents an equivalent capacitance and an equivalent resistance and compensates stability of system using the equivalent capacitance and the equivalent resistance. The regulator includes a power transistor that receives a driving signal and channelize the required current to the Ips driven by this block. The regulator's stability is compensated using the active compensation circuit to provide an accurate output voltage without significantly compromising the accuracy (load regulation) and area of the system.

17 Claims, 7 Drawing Sheets

(56) References Cited

U.S. PATENT DOCUMENTS

| | | | | |
|---|---|---|---|---|
| 2013/0249294 | A1* | 9/2013 | Saito | G05F 1/575<br>307/43 |
| 2017/0090494 | A1* | 3/2017 | Cui | G05F 1/562 |
| 2019/0187735 | A1* | 6/2019 | Ramos | G05F 1/575 |
| 2021/0034087 | A1 | 2/2021 | Liu et al. | |

FOREIGN PATENT DOCUMENTS

| | | | | | |
|---|---|---|---|---|---|
| CN | 108880228 | A | * | 11/2018 | H02M 3/00 |
| KR | 20130003603 | A | * | 1/2013 | |
| TW | 202219685 | A | * | 5/2022 | G05F 1/445 |
| WO | WO 02054167 | A1 | | 7/2002 | |

* cited by examiner

ACTIVE COMPENSATION CIRCUIT FOR A SEMICONDUCTOR REGULATOR

BACKGROUND

Technical Field

This application is directed to an active compensation circuit for a regulator and, in particular, an active compensation circuit that presents an equivalent capacitance and an equivalent resistance to the regulator.

Description of the Related Art

An analog voltage regulator is used to regulate an output voltage supplied to a load. In particular, a voltage regulator provides an output voltage within a specified range while maintaining current supply requirements. In many applications, there is a demand to supply a wide range of load currents. Supplying a wide range of load currents makes stabilizing a system challenging particularly when operating within integrated circuit area constraints.

BRIEF SUMMARY

An active compensation circuit for a regulator is provided. The active compensation circuit presents a resistance-capacitance (RC) filter for compensating the regulator. The RC filter includes an equivalent capacitance and an equivalent resistance that are serially coupled. The active compensation circuit reduces integrated circuit area resources by enhancing and increasing a value of the equivalent capacitance using feedback. The active compensation circuit presents an equivalent resistance using transistors in saturation and controls the equivalent resistance using an internal compensation current.

The active compensation circuit mirrors a current flowing through a power transistor of the regulator to generate a sensed current. The active compensation circuit aggregates the sensed current and a fixed or static internal current to generate the compensation current. The active compensation circuit uses the compensation current to present the equivalent capacitance and the equivalent resistance for controlling the regulator.

DETAILED DESCRIPTION

Figure 1:
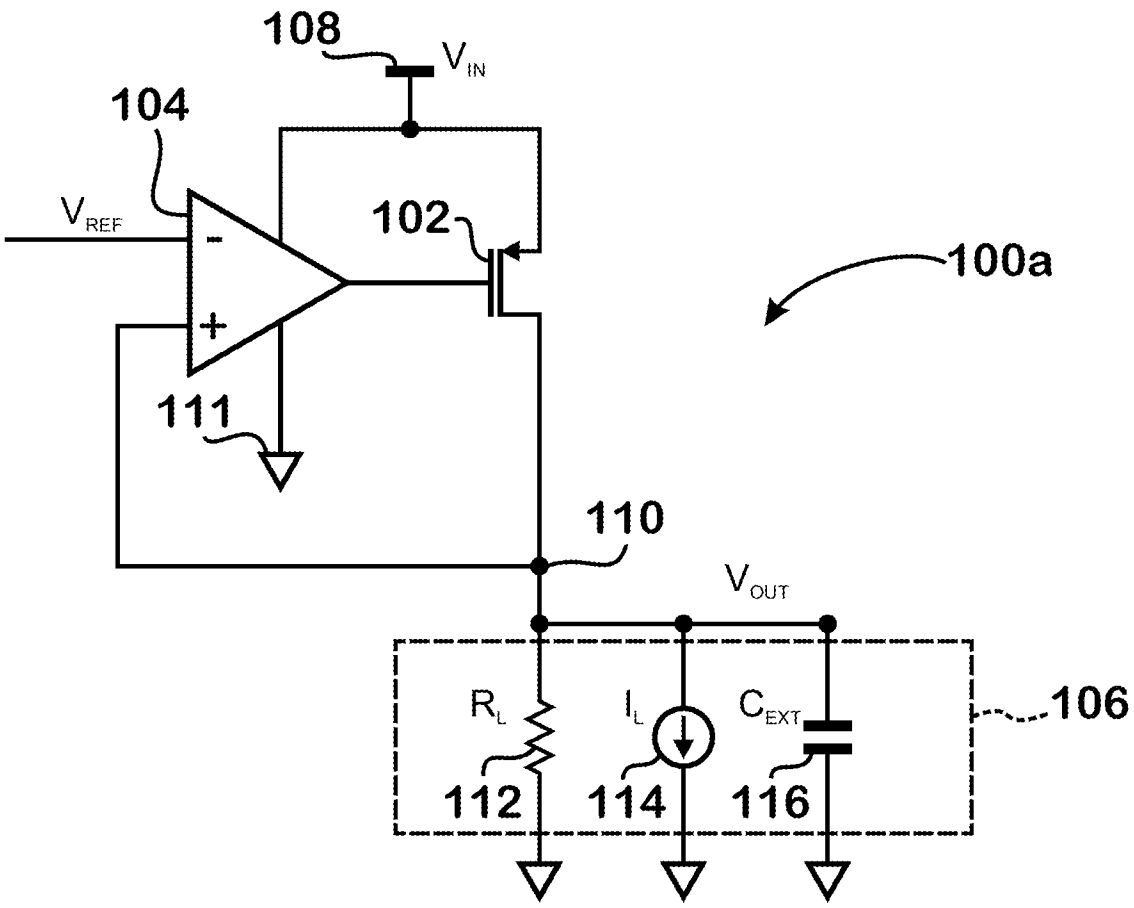
FIG. 1 shows a circuit schematic of a regulator.

FIG. 1 shows a circuit schematic of regulator 100*a*. The regulator 100*a* employs transistor regulation. The regulator

100*a* includes a power transistor 102, which is also referred to as a pass transistor. The regulator 100*a* includes an operational amplifier 104 for driving the power transistor 102. During operation, the regulator 100*a* provides an output voltage ($V_{OUT}$) to a load 106. The load 106 may be external to the regulator 100*a*, and, accordingly, the load 106 may be not part of the regulator 100*a*.

The power transistor 102 has a control terminal, a first conduction terminal and a second conduction terminal. The first conduction terminal is coupled to an input node 108 configured to supply an input voltage ($V_{IN}$) to the regulator 100*a*. The second conduction terminal is coupled to an output node 110 over which the output voltage ($V_{OUT}$) is provided. During operation, the load 106 is coupled to the output node 110. The load 106 receives the output voltage ($V_{OUT}$) over the output node 110.

The operational amplifier 104 has a first input, a second input and an output. The operational amplifier 104 receives a reference voltage ($V_{REF}$) over the first input. The reference voltage ($V_{REF}$) may be a sought or desired value for the output voltage ($V_{OUT}$). For example, the reference voltage ($V_{REF}$) may represent a voltage level (scaled or unscaled) sought to be output by the regulator 100*a*. The second input of the operational amplifier 104 is coupled to the output node 110. The operational amplifier 104 receives the output voltage ($V_{OUT}$) over the second input. Alternatively, the operational amplifier 104 may receive a voltage representative of the output voltage ($V_{OUT}$). The received voltage may be the output voltage ($V_{OUT}$) having undergone voltage division, for example, by a resistive voltage divider.

The operational amplifier 104 has a first supply input and a second supply input. The first supply input is coupled to the input node 108. The operational amplifier 104 is configured to receive the input voltage ($V_{IN}$) over the first supply input. The second supply input is coupled to ground 111 to provide the operational amplifier 104 with a reference voltage.

The output of the operational amplifier 104 is coupled to the control terminal of the power transistor 102. The operational amplifier 104 compares the output voltage ($V_{OUT}$) and the reference voltage ($V_{REF}$) and generates a control signal for driving the power transistor 102 based on the comparison. For example, if the output voltage ($V_{OUT}$) is less than the reference voltage ($V_{REF}$), the operational amplifier 104 sets the control signal to the active state (e.g., logical one). Accordingly, the power transistor 102 operates in the conductive state to increase the output voltage ($V_{OUT}$) provided to the load 106. The load 106 is represented in FIG. 1 as a load resistance ($R_L$) 112, a current source 114 that sinks a load current ($I_L$) and an external capacitance ($C_{EXT}$) 116.

Figure 2:
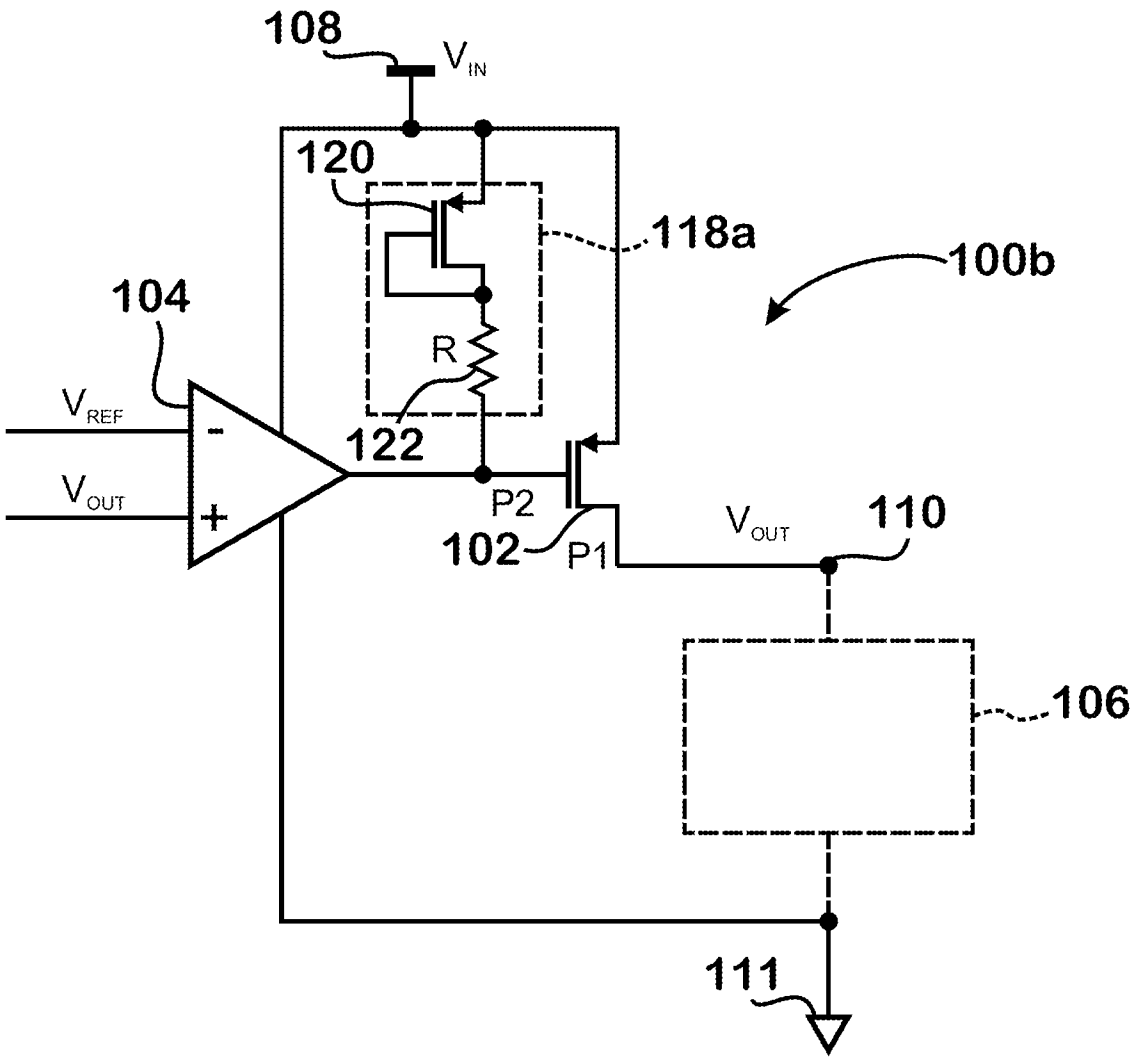
FIG. 2 shows a circuit schematic of a regulator having a compensation circuit.

FIG. 2 shows a circuit schematic of regulator 100*b* having a compensation circuit 118*a*. The compensation circuit 118*a* is coupled between the input node 108 and the control terminal of the power transistor 102. In particular, the compensation circuit 118*a* includes a compensation transistor 120 and a compensation resistance (R) 122. The compensation transistor 120 has a first conduction terminal coupled to the input node 108. The compensation transistor 120 has a second conduction terminal and a control terminal that are coupled to each other. The compensation resistance 122 has a first terminal coupled to the second conduction terminal and the control terminal of the compensation transistor 120. The compensation resistance 122 has a second terminal coupled to the control terminal of the power transistor 102.

The compensation transistor 120 provides a voltage-controlled resistance. As the load current ($I_L$) increases, the voltage at the control terminal of the power transistor 102 will decrease. Consequently, the gate-source voltage (vgs) between the control terminal and the second conduction terminal of the compensation transistor 120 and the transconductance ($g_m$) of the compensation transistor 120 increase. The equivalent resistance of the compensation circuit 118*a* is the sum of the compensation resistance (R) 122 and the resistance ($1/g_m$) the compensation transistor 120. The equivalent resistance, $R+1/g_m$, decreases as the load current ($I_L$) increases. Further, the loop gain decreases and a first pole (denoted "P1") representing the load 106 at the output of the regulator 100*b* shifts rightward to higher frequency. Correspondingly, a second pole (denoted "P2") associated with the compensation circuit 118*a* also shifts to track the first pole (P1). However, lowering the loop gain degrades the load regulation provided by the regulator 100*b*.

To compensate for the second pole (P2), a resistance-capacitance (RC) filter may be used. The RC filter introduces a zero (denoted "Z1") that offsets the second pole (P2).

Figure 3:
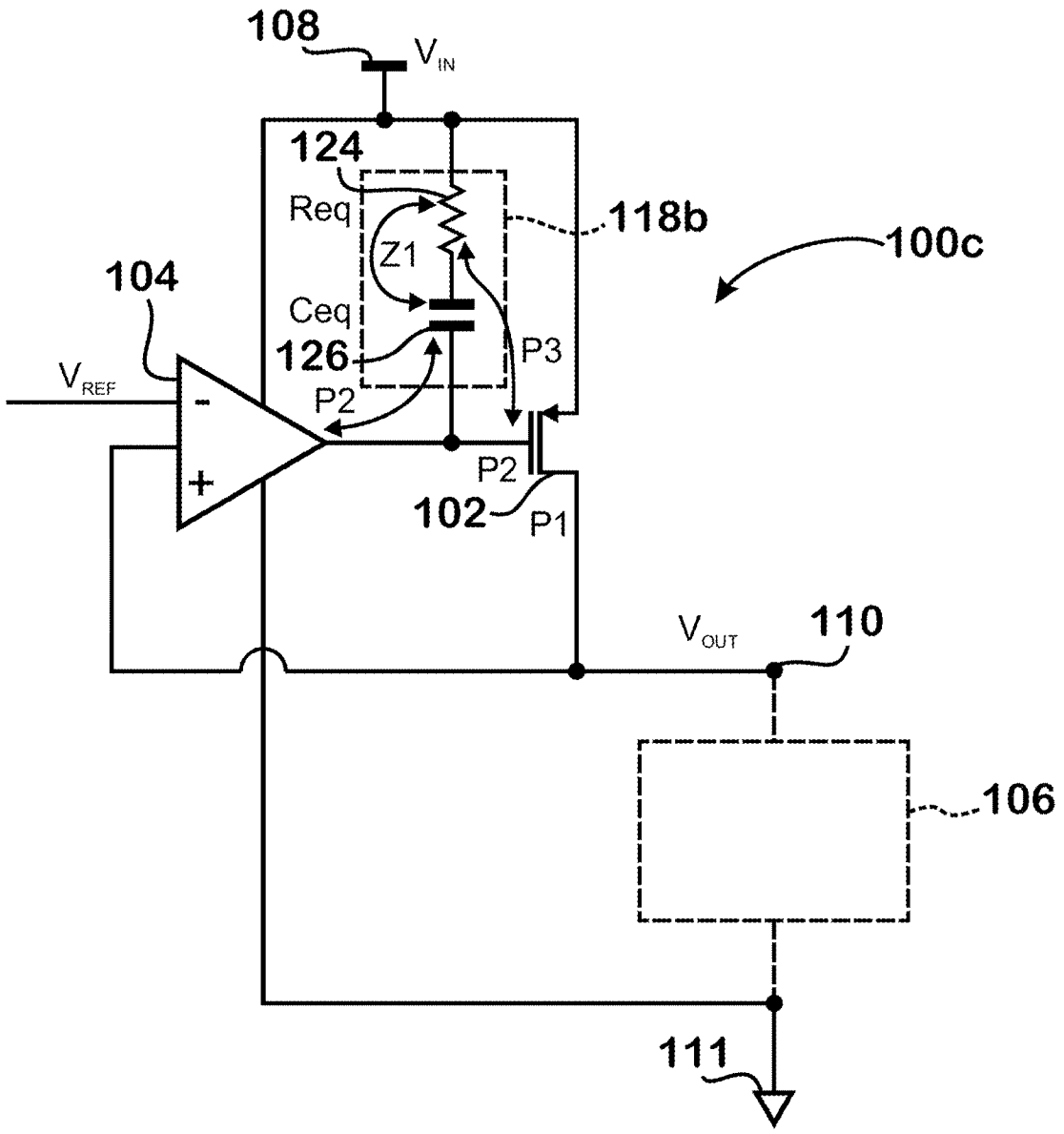
FIG. 3 shows a circuit schematic of a regulator having a compensation circuit.

FIG. 3 shows a circuit schematic of regulator 100*c* having a compensation circuit 118*b*. The compensation circuit 118*b* is coupled between the input node 108 and the control terminal of the power transistor 102. The compensation circuit 118*b* includes a compensation resistance (Req) 124 and a compensation capacitance (Ceq) 126. The compensation resistance 124 has a first terminal coupled to the input node 108 and a second terminal. The compensation capacitance 126 has a first side coupled to the second terminal of the compensation resistance 124. The compensation capacitance 126 has a second side coupled to the control terminal of the power transistor 102.

The compensation circuit 118*b* introduces the zero (Z1) to offset the second pole (P2). The compensation circuit 118*b* also introduces a third pole (denoted "P3"). In particular, the first pole (P1) is represented as:

$$P_1 = \frac{1}{Cext(R_o \| RL)}, \quad \text{Equation (1)}$$

where $R_o$ is the output resistance of the power transistor 102 and ‖ represents a parallel resistance.

The second pole (P2) is represented as:

$$P_2 = \frac{1}{((C_g + Ceq)R_{oamp}) + Ceq * Req)}, \quad \text{Equation (2)}$$

where $C_g$ is the capacitance associated with the power transistor 102 and $R_{oamp}$ is the output resistance of the operational amplifier 104.

The first zero (Z1) is represented as:

$$Z_1 = \frac{1}{Ceq * Req}. \quad \text{Equation (3)}$$

The third pole (P3) is represented as:

$$P_3 = \frac{1}{Req}\left(\frac{1}{Ceq} + \frac{1}{C_g}\right). \quad \text{Equation (4)}$$

To achieve a desired phase margin, it is sought that the unity gain bandwidth (UGB) is less than the third pole (P3) and greater than both the second pole (P2) and the first zero (Z1). Accordingly, with a varying load current ($I_L$), a pole-zero doublet of the third pole (P3) and the first zero (Z1) is moved to maintain the criterion of the unity gain bandwidth between the third pole (P3) and the first zero (Z1). Per Equations 3 and 4, both the third pole (P3) and the first zero (Z1) are a function of the compensation resistance (Req) 124.

Achieving the unity gain bandwidth criterion calls for the compensation capacitance (Ceq) 126 to be greater than five times the capacitance ($C_g$) associated with the power transistor 102. For example, if the capacitance ($C_g$) associated with the power transistor 102 is 4 to 7 picofarad (pF), then the compensation capacitance (Ceq) 126 is at least 20 to 40 pF. In addition, the output resistance ($R_{oamp}$) of the operational amplifier 104 is sought to be greater (or considerably greater) than the compensation resistance (Req) 124.

An active RC compensation circuit 118 or 128 is used to enhance the compensation capacitance (Ceq). The active RC compensation circuit has a smaller footprint than a conventional passive compensation circuit and occupies a smaller implementation space in an integrated circuit to implement the compensation capacitance (Ceq). The integrated circuit of the disclosed active compensation circuit 118 or 128 can be formed from any acceptable semiconductor substrate which might include silicon, gallium arsenide or other acceptable semiconductor material used for integrated circuit. In one embodiment, the active RC compensation circuit will be in the same semiconductor substrate and part of the same integrated circuit as the power transistor 102 having the control terminal to which it is coupled. In other embodiments, the active compensation circuit 118 or 128 will be in a separate integrated circuit and on a separate substrate from the power transistor 102. Accordingly, in one embodiment, the operational amplifier is on the same semiconductor substrate at the power transistor, while in other embodiments, they are on different substrates. In one embodiment, the operational amplifier, the variable value capacitance, the variable value equivalent resistance and the power transistor are all on the same semiconductor substrate, while in other embodiments, the power transistor is on its own substrate and the operational amplifier, the variable value capacitance and the variable value equivalent resistance are on the same substrate with each other, positioned closely to the substrate holding the power transistor.

The active RC compensation circuit 118, 128 enhances the compensation capacitance using feedback and results in a higher equivalent active capacitance. In the active RC compensation circuit, an equivalent active resistance is implemented using transistors in saturation, where control of a bias current results in control of the equivalent active resistance.

Figure 4:
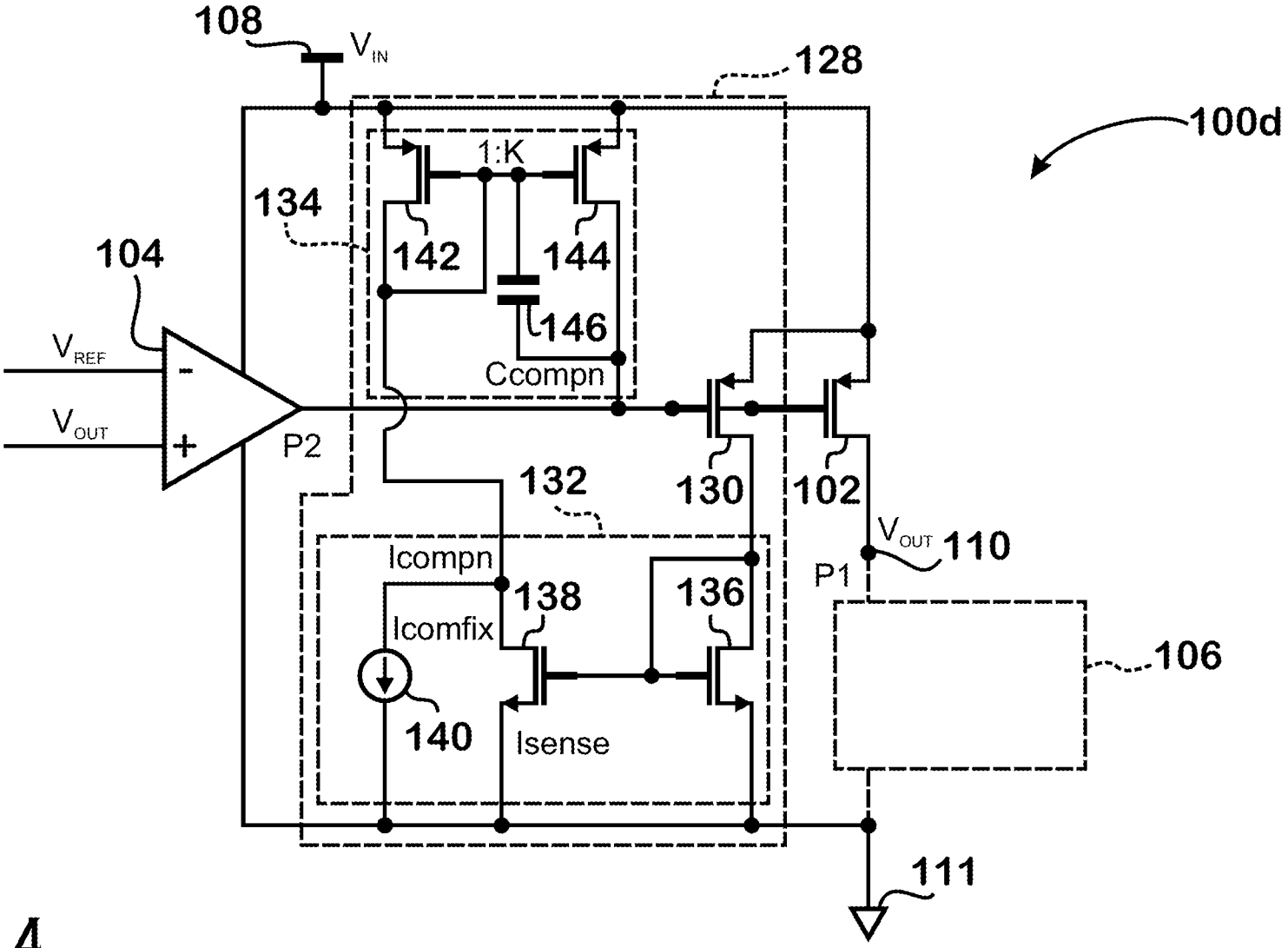
FIG. 4 shows a circuit schematic of a regulator having an active compensation circuit.

FIG. 4 shows a circuit schematic of regulator 100*d* having an active compensation circuit 128. The active compensation circuit 128 includes a mirror transistor 130, a first compensation stage 132 and a second compensation stage 134. The first compensation stage 132 includes first and second compensation transistors 136, 138 and a compensation current source 140. The second compensation stage 134 includes third and fourth compensation transistors 142, 144 and a compensation capacitance (Ccompn) 146.

The mirror transistor 130 has a first conduction terminal coupled to the first conduction terminal of the power transistor 102 and a control terminal coupled to the control terminal of the power transistor 102. The mirror transistor 130 has a second conduction terminal.

In the first compensation stage 132, the first compensation transistor 136 has a first conduction terminal and a control terminal that are both coupled to the second conduction terminal of the mirror transistor 130. The first compensation transistor 136 has a second conduction terminal coupled to ground 111. It is noted that although ground is described herein as a reference voltage, any reference voltage source may be used.

The second compensation transistor 138 has a control terminal coupled to the control terminal of the first compensation transistor 136. The second compensation transistor 138 has a first conduction terminal. The second compensation transistor 138 has a second conduction terminal coupled o ground 111. The compensation current source 140 has an anode coupled to the first conduction terminal of the second compensation transistor 138. The compensation current source 140 has a cathode coupled to ground 111.

In the second compensation stage 134, the third compensation transistor 142 has a first conduction terminal coupled to the input node 108 and a second conduction terminal and a control terminal that are both coupled to the first conduction terminal of the second compensation transistor 138.

The fourth compensation transistor 144 has a first conduction terminal coupled to the input node 108, a second conduction terminal coupled to the control terminal of the power transistor 102 and a control terminal coupled to the control terminal of the third compensation transistor 142. The compensation capacitance 146 has a first side coupled to the control terminal of the fourth compensation transistor 144 and a second side coupled to the second conduction terminal of the fourth compensation transistor 144.

During operation, the load 106 is coupled to the output node and the power transistor 104 outputs the output voltage ($V_{OUT}$) at the output node 110. The load 106 draws or sinks the load current ($I_L$). The load current ($I_L$) flows through the power transistor 102 to the load 106. The mirror transistor 130 mirrors the current flowing through the power transistor 104.

Due to the coupling of the mirror transistor 130 and the first compensation transistor 136, the same current passes passing through the mirror transistor 130 also passes through the first compensation transistor 136 in the first compensation stage 132. Sensing the current passing through the mirror transistor 130 is tantamount to sensing the overvoltage ($V_{OV}$) of the power transistor 102. The first compensation stage 132 copies the current passing through the first compensation transistor 136 to the second compensation transistor 138, whereby the current passing through the second compensation transistor 138 is the sensed current (Isense).

The compensation current source 140 generates a current (Icomfix). The generated current (Icomfix) is additively combined with the sensed current (Isense) to produce a compensation current (Icompn). The compensation current (Icompn) passes through the third compensation transistor 142. The third and fourth compensation transistors 142, 144 has a current mirror ratio of K, where the transconductance of the fourth compensation transistor 144 ($g_4$) is K times the transconductance of the third compensation transistor 142 ($g_3$) ($g_4=Kg_3$). The current mirror arrangement of the third and fourth compensation transistors 142, 144 results in the current flowing through the fourth compensation transistor 144 compensating the regulator 100*d*.

The output resistance of the third and fourth compensation transistors 142, 144 is considerably large. The equivalent capacitance (Ceq) of the active compensation circuit 128 is:

$$Ceq = \left(1 + \frac{g_4}{g_3}\right) * Ccompn = (1 + K) * Ccompn. \quad \text{Equation (5)}$$

Further, the equivalent resistance (Req) of the active compensation circuit 128 is:

$$Req = \frac{1}{g_3\left(1 + \frac{g_4}{g_3}\right)} = \frac{1}{g_3(1 + K)}. \quad \text{Equation (6)}$$

Per Equation (5), the active compensation circuit 128, as an active block, produces an equivalent capacitance (Ceq) that is a multiple of compensation capacitance (Ccompn) 146. The equivalent capacitance (Ceq) is a 1+K multiple of compensation capacitance (Ccompn) 146. Increasing the current mirror ratio between of the fourth compensation transistor 144 and the third compensation transistor 142 increases the capacitive multiplicative effect of the active compensation circuit 128. Space saving on a circuit is achieved by the capacitive multiplicative effect due to the fact that a smaller compensation capacitance (Ccompn) 146 is multiplied by a factor that is greater than one to obtain the equivalent capacitance (Ceq). The equivalent capacitance (Ceq) is therefore a variable capacitance based on the multiplier 1+K. The equivalent capacitance (Ceq) will therefore become greater without increasing the size the space being used on the integrated circuit substrate in which the compensation circuit is formed.

Per Equation (6), the equivalent resistance (Req) is negatively correlated with the factor 1+K and with the transconductance of the third compensation transistor 142 ($g_3$). The transconductance of the third compensation transistor 142 ($g_3$) is proportional to the square root of the compensation current (Icompn) (e.g., $g_3 \alpha \sqrt{Icompn}$). The active compensation circuit 128 modulates the compensation current (Icompn) to control the equivalent resistance (Req).

The equivalent resistance (Req) is therefore a variable resistance. The multiplier 1+K is the same multiplier that used for the equivalent capacitance (Ceq) and may be fixed for a particular circuit in saturation because the ratio for the fourth compensation transistor 144 and the third compensation transistor 142 may be fixed. The equivalent resistance (Req) may be changed by changing the transconductance of the third compensation transistor 142, the compensation current (Icompn) or size of the third compensation transistor 142. The variability of the equivalent resistance (Req) can become greater (or smaller) without increasing (or decreasing) the size the space being used on the integrated circuit substrate in which the compensation circuit is formed.

The active compensation circuit 128 reduces the impedance at the input of the power transistor 102 for higher frequencies without degrading the loop gain. The second pole ($P_2$) will be compensated by introducing a zero ($Z_1$), Which makes the third pole ($P_3$) as an equivalent second pole. Furthermore, the equivalent second pole ($P_3$) tracks a movement of the first pole ($P_1$). As described herein, the active compensation circuit 128 uses load current sensing to modulate the location of pole-zero doublet such that it tracks the dominant pole ($P_1$) at the output of the power transistor 102. In particular, the active compensation circuit 128 modulates the location of pole-zero doublet such that the unitary gain band (UGB) satisfies:

$$P_1<P_2<UGB\approx Z_1<P_3 \quad \text{Equation (7).}$$

During operation, the transistors 136, 138, 142, 144 are operated in saturation and used to obtain a small signal resistance ($1/g_m$).

Figure 5A:
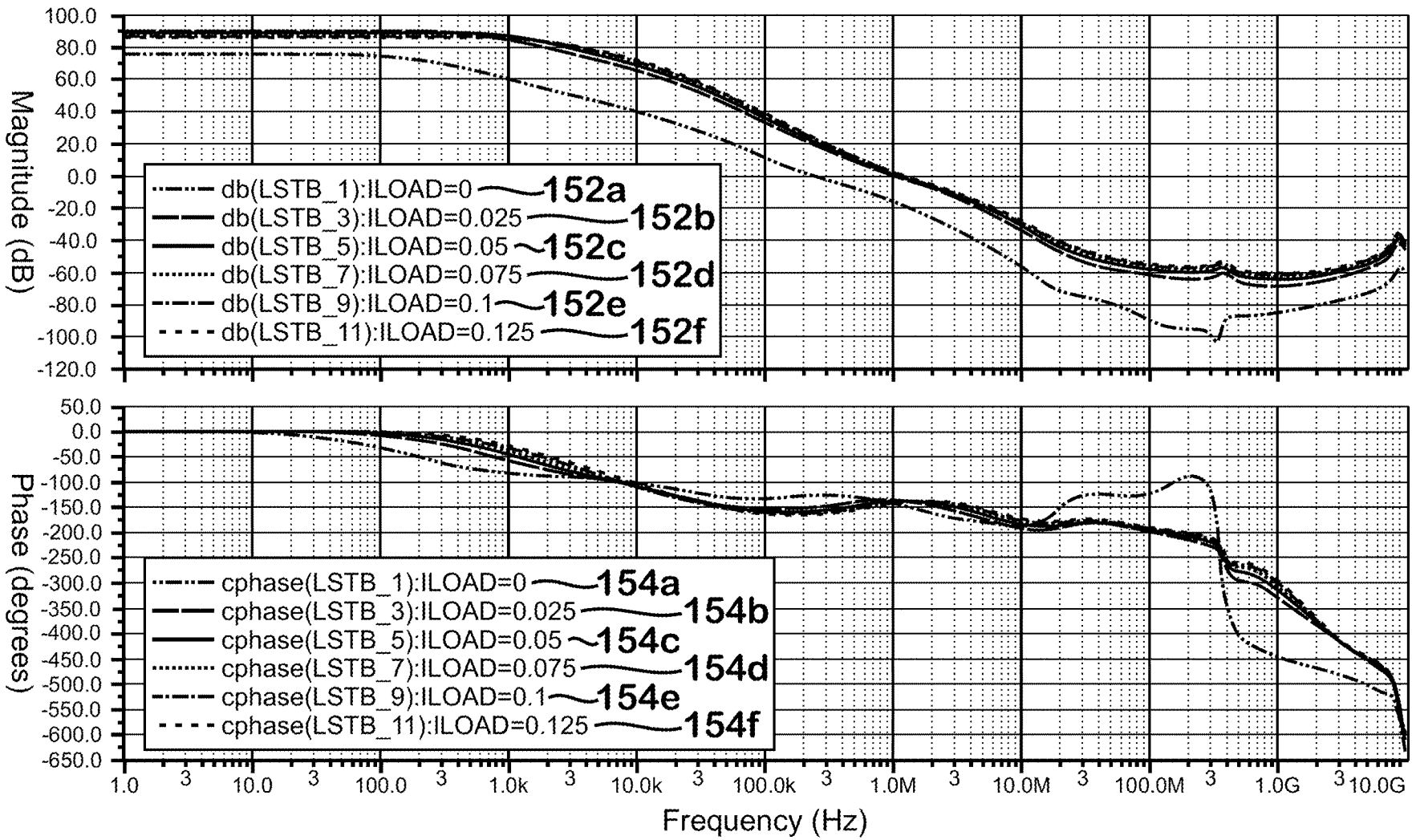
FIG. 5A shows a Bode plot for the regulator having the active compensation circuit.
Figure 5B:
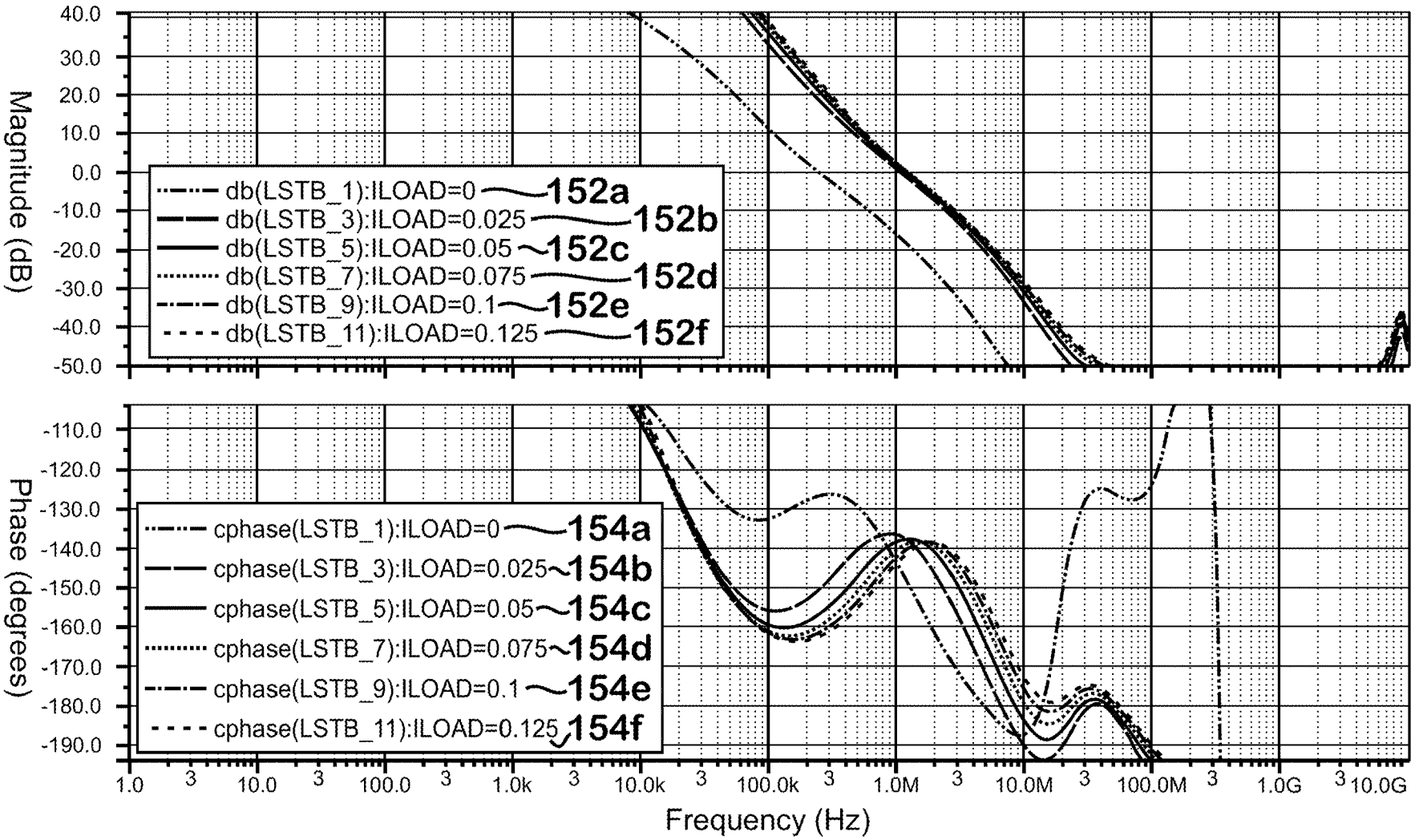
FIG. 5B shows magnitude and phase plots surrounding the unitary gain band of 0 decibels (dB) for the load currents of zero, 0.025, 0.05, 0.075, 0.1 and 0.125 A.

FIG. 5A shows a Bode plot for the regulator 100*d* having the compensation circuit 128. The Bode plot shows respective magnitude 152*a-f* and phase 154*a-f* plots for load currents of zero, 0.025, 0.05, 0.075, 0.1 and 0.125 A. FIG. 5B shows magnitude 152*a-f* and phase 154*a-f* plots surrounding the unitary gain band of 0 decibels (dB) for the load currents of zero, 0.025, 0.05, 0.075, 0.1 and 0.125 A. As seen in FIGS. 5A and 5B, a phase boost peak changes in relation to the load current. The regulator 100*d* provides a phase boost in a proximity of the unitary gain band.

Figure 6:
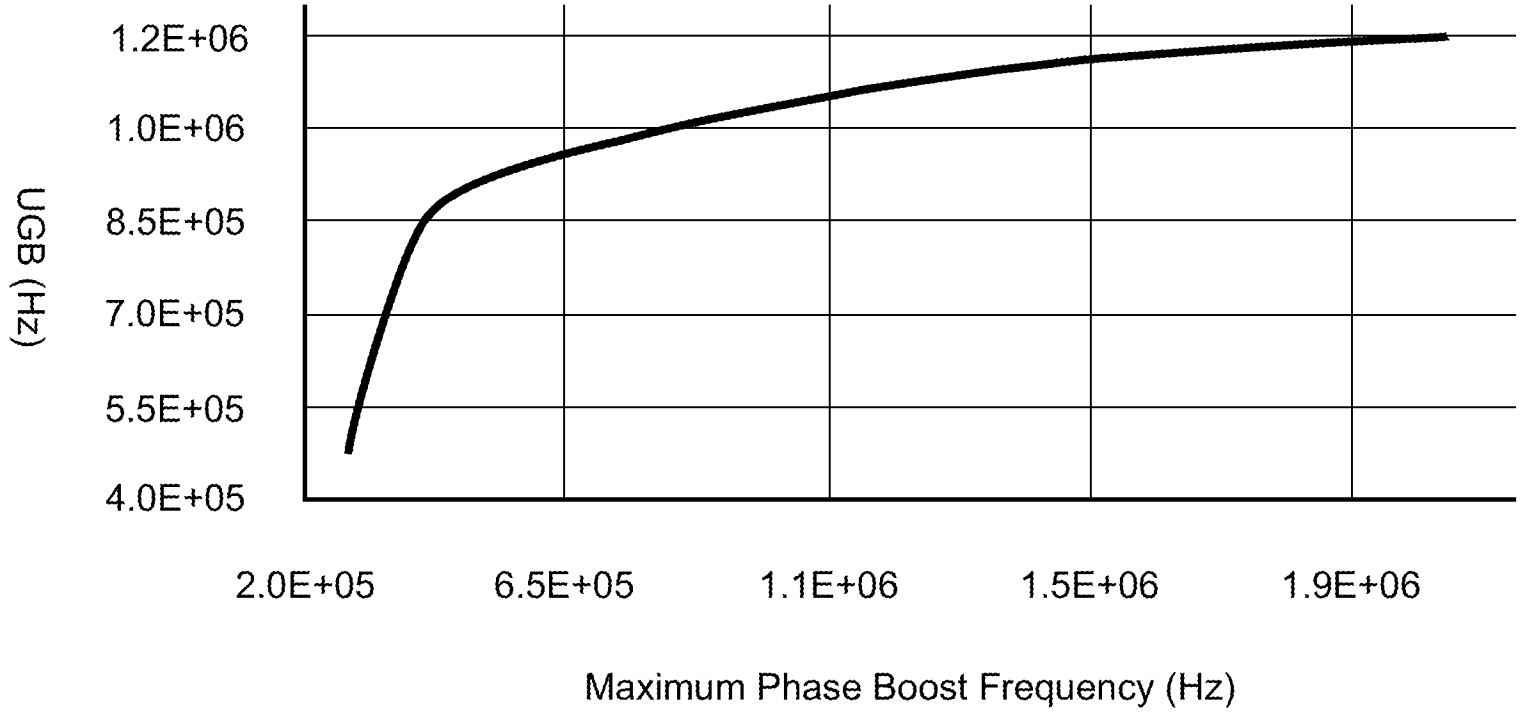
FIG. 6 shows a relationship between the maximum phase boost frequency and the unitary gain band.

FIG. 6 shows a relationship between the maximum phase boost frequency and the unitary gain band. As can be seen in FIG. 6, as the frequency of the maximum phase boost increases so does the unitary gain band. Further, in a region of linearity surrounding 1.1 megahertz (MHz), the maximum phase boost frequency coincides with the unitary gain band.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A semiconductor regulator, comprising:

an input node configured to provide a supply voltage;

an output node;

an operational amplifier having an output configured to output a signal;

a power transistor having a first conduction terminal coupled to the input node, a second conduction terminal coupled to the output node and a control terminal, the power transistor being configured to:

receive, over the control terminal, the signal generated by the operational amplifier for driving the power transistor; and provide an output voltage over the output node; and an active compensation circuit having an output coupled to the control terminal of the power transistor and the output of the operational amplifier and having an input coupled to the input node, the active compensation circuit being configured to present a variable value equivalent capacitance and a variable value equivalent resistance to compensate the output voltage provided on the output node, wherein the operational amplifier, the variable value equivalent capacitance, the variable value equivalent resistance and the power transistor are all on the same semiconductor substrate.

2. The regulator as claimed in claim 1, wherein the operational amplifier has a first input configured to receive a reference voltage and a second input configured to receive the output voltage, wherein the operational amplifier is configured to compare the reference voltage and the output voltage and generate the signal for driving the power transistor based on comparing the reference voltage and the output voltage.

3. The regulator as claimed in claim 1, wherein the active compensation circuit includes:

a mirror transistor having a first conduction terminal coupled to the first conduction terminal of the power transistor and a control terminal coupled to the control terminal of the power transistor, wherein the mirror transistor has a second conduction terminal.

4. The regulator as claimed in claim 3, wherein the active compensation circuit includes:

a first compensation stage including first and second compensation transistors in a current mirror configuration and a current source; and a second compensation stage including third and fourth compensation transistors in a current mirror configuration and a compensation capacitance.

5. The regulator as claimed in claim 4, wherein:

the first compensation transistor has a first conduction terminal and a control terminal coupled to the second conduction terminal of the mirror transistor and a second conduction terminal coupled to a reference voltage node, the second compensation transistor has a control terminal coupled to the control terminal of the first compensation transistor and a second conduction terminal coupled to the reference voltage node, wherein the second compensation transistor has a first conduction terminal, and the current source has a first terminal coupled to the first conduction terminal of the second compensation transistor and a second terminal coupled to the reference voltage node.

6. The regulator as claimed in claim 4, wherein:

the third compensation transistor has a first conduction terminal coupled to the input node and a second conduction terminal and a control terminal coupled to the first conduction terminal of the second compensation transistor;

the fourth compensation transistor has a first conduction terminal coupled to the input node, a control terminal coupled to the control terminal of the third compensation transistor and a second conduction terminal coupled to the control terminal of the power transistor; and the compensation capacitance between the control terminal and the second conduction terminal of the fourth compensation transistor.

7. The regulator as claimed in claim 4, wherein the variable value equivalent capacitance is a 1+K multiple of the compensation capacitance and K is a ratio of a transconductance of the fourth compensation transistor to a transconductance of the third compensation transistor.

8. The regulator as claimed in claim 4, wherein the current source is configured to supply a first current, wherein the second compensation stage is configured to aggregate the first current to a sensed current mirroring a current flowing through the power transistor, and wherein the active compensation circuit is configured to compensate the regulator based on the aggregate of the first current and the sensed current.

9. A method, comprising: presenting, by an active compensation circuit, a variable value equivalent capacitance and a variable value equivalent resistance;

outputting, by an operational amplifier over an output of the operational amplifier, a signal for driving a power transistor, the power transistor having:

a first conduction terminal coupled to an input node configured to provide a supply voltage, a second conduction terminal, and a control terminal;

compensating the signal for driving the power transistor using the variable value equivalent capacitance and the variable value equivalent resistance;

receiving, by the power transistor over the control terminal, the signal for driving the power transistor; and providing, by the power transistor, an output voltage over the second conduction terminal, wherein:

the operational amplifier, the variable value equivalent capacitance, the variable value equivalent resistance and the power transistor are all on the same semiconductor substrate, and the active compensation circuit has an output coupled to the control terminal of the power transistor and the output of the operational amplifier and has an input coupled to the input node.

10. The method as claimed in claim 9, comprising:

comparing the output voltage to a reference voltage; and generating the signal for driving the power transistor based on comparing the output voltage to the reference voltage.

11. The method as claimed in claim 9, comprising:

mirroring a current flowing through the power transistor; and generating a sensed current.

12. The method as claimed in claim 11, comprising:

adding a first current to the sensed current to generate a compensation current; and compensating the signal for driving the power transistor based on the compensation current.

13. The method as claimed in claim 9, wherein the variable value equivalent capacitance is a 1+K multiple of a compensation capacitance of the active compensation circuit and K is a ratio of a transconductance of a first compensation transistor of the active compensation circuit to a transconductance of a second compensation transistor of the active compensation circuit.

14. The method as claimed in claim 13, wherein the variable value equivalent resistance is inversely correlated with a transconductance of the first compensation transistor and the ratio of the transconductance of the first compensation transistor of the active compensation circuit to the transconductance of the second compensation transistor of the active compensation circuit.

15. A system, comprising:

an operational amplifier having first and second inputs and an output and configured to:

receive an output voltage and a reference voltage over the first input and the second input, respectively;

compare the output voltage to the reference voltage;

generate a driving signal based on comparing the output voltage to the reference voltage;

output the driving signal over the output;

a power transistor having a first conduction terminal coupled to an input node configured to provide a supply voltage, a second conduction terminal and a control terminal and configured to:

receive the driving signal over the control terminal; and provide, over the second conduction terminal, the output voltage based on the driving signal; and an active compensation circuit having an output coupled to the control terminal of the power transistor and the output of the operational amplifier and an input coupled to the input node and configured to:

present a variable value equivalent capacitance and a variable value equivalent resistance; and compensate the power transistor based on the variable value equivalent capacitance and the variable value equivalent resistance, wherein the operational amplifier, the variable value equivalent capacitance, the variable value equivalent resistance and the power transistor are all on the same semiconductor substrate.

16. The system as claimed in claim 15, wherein the active compensation circuit includes:

a mirror transistor configured to mirror a current flowing through the power transistor.

17. The system as claimed in claim 16, wherein the active compensation circuit includes:

a first compensation stage including first and second compensation transistors in a current mirror configuration and a current source; and a second compensation stage including third and fourth compensation transistors in a current mirror configuration and a compensation capacitance.

* * * * *